US010603763B2

(12) United States Patent
Liu et al.

(10) Patent No.: US 10,603,763 B2
(45) Date of Patent: Mar. 31, 2020

(54) WHEEL SHAPE FOLLOW-UP BURR BRUSHING DEVICE

(71) Applicant: CITIC Dicastal CO., LTD., Qinhuangdao, Hebei (CN)

(72) Inventors: Huiying Liu, Qinhuangdao (CN); Yongwang Zhao, Qinhuangdao (CN); Lijie Hu, Qinhuangdao (CN)

(73) Assignee: CITIC Dicastal CO., LTD., Qinhuangdao, Hebei (CN)

( * ) Notice: Subject to any disclaimer, the term of this patent is extended or adjusted under 35 U.S.C. 154(b) by 166 days.

(21) Appl. No.: 15/904,842

(22) Filed: Feb. 26, 2018

(65) Prior Publication Data

US 2019/0193241 A1 Jun. 27, 2019

(30) Foreign Application Priority Data

Dec. 25, 2017 (CN) ..... 2017 1 1417908

(51) Int. Cl.

| | |
|---|---|
| ***B24B 41/02*** | (2006.01) |
| ***B24B 19/28*** | (2006.01) |
| ***B24B 9/04*** | (2006.01) |
| ***B24B 5/44*** | (2006.01) |
| ***B24B 47/12*** | (2006.01) |

(Continued)

(52) U.S. Cl.

CPC ..... *B24B 47/12* (2013.01); *B24B 5/44* (2013.01); *B24B 9/02* (2013.01); *B24B 9/04* (2013.01); *B24B 19/28* (2013.01); *B24B 29/005* (2013.01); *B24B 31/003* (2013.01); *B24B 41/005* (2013.01); *B24B 41/02* (2013.01); *B24B 41/06* (2013.01); *B24D 13/145* (2013.01)

(58) Field of Classification Search

CPC .... B24B 5/44; B24B 9/02; B24B 9/04; B24B 19/28; B24B 27/0023; B24B 27/0069; B24B 27/0076; B24B 29/005; B24B 41/005; B24B 41/02; B24D 13/145

USPC ..... 451/57, 65

See application file for complete search history.

(56) References Cited

U.S. PATENT DOCUMENTS 3,258,804 A * 7/1966 Fowle ..... B24B 5/225 15/88
4,216,560 A * 8/1980 Schmidt ..... B24B 41/06 15/268

(Continued)

FOREIGN PATENT DOCUMENTS

GB 667407 A * 2/1952 ..... B24B 5/44
JP 3044289 B2 * 5/2000
JP 3091417 B2 * 9/2000

*Primary Examiner* — Eileen P Morgan
(74) *Attorney, Agent, or Firm* — Cooper Legal Group, LLC

(57) ABSTRACT

A wheel shape follow-up burr brushing device can brush burrs from a front, a back cavity and a spoke root groove of the wheel. The heights of brushes are adjusted, so that the brushes follow up the shape of the front, the back cavity and the spoke root groove of the wheel. The wheel is put onto a positioning roller bed by a manipulator, a positioning clamping cylinder drives four clamping wheels to clamp the wheel, four clamping wheel drive motors drive the wheel to be in a low-speed rotating state; two second cylinders drive a second rotating table to be fed downwards, two first cylinders drive a first rotating table to be fed upwards, and the rotating wheel is matched with the rotating brushes to brush burrs from the front, the back cavity and the spoke root groove of the wheel.

1 Claim, 10 Drawing Sheets

(51) Int. Cl.

| | |
|---|---|
| ***B24B 31/00*** | (2006.01) |
| ***B24B 29/00*** | (2006.01) |
| ***B24D 13/14*** | (2006.01) |
| ***B24B 9/02*** | (2006.01) |
| ***B24B 41/06*** | (2012.01) |
| ***B24B 41/00*** | (2006.01) |

(56) References Cited

U.S. PATENT DOCUMENTS

| | | | | |
|---|---|---|---|---|
| 5,134,807 | A * | 8/1992 | Keefe | B24B 7/16 451/259 |
| 5,161,281 | A * | 11/1992 | Hanen | B08B 1/04 15/88.3 |
| 5,762,542 | A * | 6/1998 | Sandvold | B24B 9/002 451/188 |
| 9,782,866 | B1 * | 10/2017 | Xue | B24B 9/04 |
| 10,232,486 | B2 * | 3/2019 | Xue | B24B 5/44 |
| 2007/0037497 | A1 * | 2/2007 | Tanaka | B24B 5/44 451/312 |
| 2007/0042678 | A1 * | 2/2007 | Tanaka | B24B 5/44 451/5 |
| 2013/0102233 | A1 * | 4/2013 | Cheon | B24B 27/033 451/331 |
| 2018/0085887 | A1 * | 3/2018 | Xue | B24B 29/04 |
| 2018/0264617 | A1 * | 9/2018 | Xue | B24B 27/0076 |

* cited by examiner

WHEEL SHAPE FOLLOW-UP BURR BRUSHING DEVICE

CROSS-REFERENCE TO RELATED APPLICATIONS

The present application claims benefit of Chinese Patent Application No. 201711417908.2, filed on Dec. 25, 2017, the contents of which are hereby incorporated by reference in its entirety.

BACKGROUND

Wheel shapes increase with the increase of wheel demand, and the front and the back cavity are different in shape. The traditional brushes which are single in shape are no longer applicable to various wheels, and the place that cannot be brushed may be corroded. If a brush is designed for each wheel, the manufacturing cost is increased, and the resource is wasted. Therefore, a general burr brushing device is urgently needed, in which the structures of brushes can be adjusted to match a wheel according to the shapes of the front and the back cavity of the wheel. In such a way, burrs can be brushed thoroughly, and the manufacturing cost is greatly reduced. The device can be suitable for brushing burrs from wheels in multiple shapes by adjusting the structures of the brushes. At present, the weight reduction on a spoke root groove of the wheel is a development trend, and cut edge burrs inside the groove also need to be brushed. Based on the current situation, the present patent provides a burr brushing device, in which not only the structures of the brushes can be adjusted according to the shape of a wheel so that the brushes are matched with the shape of the wheel, but also burrs can be brushed from the spoke root groove.

SUMMARY

The disclosure relates to the technical field of wheel burr brushing, and specifically, to a device for automatically brushing burrs from the front and the back cavity of a wheel.

The aim of the disclosure is to provide a wheel shape follow-up burr brushing device, which can be used for automatic continuous production and is novel in structure, advanced in technology and strong in universality.

In order to fulfill the above aim, the technical solution of the disclosure is:

A wheel shape follow-up burr brushing device is composed of a frame, four first guide posts, two first cylinders, a first lifting table, a first servo motor, a bearing seat, a shaft, a first rotating table, six back cavity brush adjustment cylinders, a fixed plate, a first support plate, a fixed guidance key, three I-shaped sliding blocks, six wheel back cavity brushes, a second support plate, a concave block, three movable guidance keys, an angle adjustment cylinder, an upright post, a turning plate, a guide rail, a groove brush adjustment cylinder, an adjustment sliding block, a second servo motor, a third support plate, four positioning guide rails, a positioning clamping cylinder, a first sliding plate, a second sliding plate, a gear rack, four clamping wheel drive motors, four clamping wheels, two second cylinders, four second guide posts, a second lifting table, a third servo motor, a second rotating table, six sliding blocks, six front brush adjustment cylinders and a center brush adjustment cylinder.

The two first cylinders are fixed at the bottom of the frame, output ends of the two first cylinders are connected with the first lifting table, and the two first cylinders controls the up and down movements of the first lifting table under the guidance of the four first guide posts. The first servo motor is fixed on the first lifting table, the first rotating table is mounted at the output end of the first servo motor, six wheel back cavity brushes are mounted at the first half part of the first rotating table, and a spoke root groove brush is mounted at the second half part of the first rotating table.

The six back cavity brush adjustment cylinders are arranged in one row and comprise a first back cavity brush adjustment cylinder, a second back cavity brush adjustment cylinder, a third back cavity brush adjustment cylinder, a fourth back cavity brush adjustment cylinder, a fifth back cavity brush adjustment cylinder and a sixth back cavity brush adjustment cylinder arranged in a radially inward direction respectively, and are fixed at the lower part of the first rotating table via the fixed plate. Output ends of the first back cavity brush adjustment cylinder, the third back cavity brush adjustment cylinder and the fifth back cavity brush adjustment cylinder are connected with the three I-shaped sliding blocks, output ends of the second back cavity brush adjustment cylinder, the fourth back cavity brush adjustment cylinder and the sixth back cavity brush adjustment cylinder are connected with the three movable guidance keys, and grooves of the three I-shaped sliding blocks are matched with the three movable guidance keys. The first support plate is fixed on the first rotating table, the fixed guidance key is fixed on the first support plate, and the I-shaped sliding block of the three I-shaped sliding blocks closest to the first support plate is matched with the fixed guidance key. The second support plate is fixed on the first rotating table, the concave block is fixed on the second support plate, and the movable guidance key of the three movable guidance keys closest to the second support plate is matched with the concave block. A wheel back cavity brush is mounted at the top of each of the three I-shaped sliding blocks and the three movable guidance keys, and when the six back cavity brush adjustment cylinders extend and retract, the six wheel back cavity bushes can move up and down without interfering with each other under the coordination of the three I-shaped sliding blocks and the three movable guidance keys. By adjusting the heights of the six wheel back cavity brushes, the contour formed by the six wheel back cavity brushes can be consistent with the shape of the back cavity of a wheel, the six wheel back cavity brushes follow up the shape of the back cavity of the wheel, in this case, burrs can be brushed thoroughly from the back cavity of the wheel, moreover, the six wheel back cavity brushes are more universal, and the heights of the bushes can be adjusted to match wheels in different shapes, so that the production cost is greatly reduced.

Both the angle adjustment cylinder and the upright post are fixed on the first rotating table, the lower part of the turning plate is articulated with the angle adjustment cylinder, the lower part of the turning plate is articulated with the upright post, both the groove brush adjustment cylinder and the guide rail are fixed on the turning plate, the output end of the groove brush adjustment cylinder is connected with the adjustment sliding block, the adjustment sliding block is mounted on the guide rail, the second servo motor is fixed on the adjustment sliding block, and a spoke root groove brush is mounted at the output end of the second servo motor. The inclination angle of the spoke root groove brush can be adjusted via the angle adjustment cylinder, so that the spoke root groove brush is consistent with a spoke root groove in angle; the depth of the spoke root groove brush entering the groove can be adjusted via the groove brush adjustment cylinder, so that the spoke root groove brush is consistent with the spoke root groove in depth; the spoke root groove brush can rotate via the second servo motor, and under the coordination of rotation of the wheel, burrs can be cleaned from the spoke root groove.

The third support plate is fixed in the middle of the frame, the four positioning guide rails are symmetrically mounted on the third support plate, the first sliding plate and the second sliding plate are symmetrically mounted on the four positioning guide rails and connected with each other via the gear rack, the first sliding plate and the second sliding plate are respectively provided with two clamping wheel drive motors, a clamping wheel is mounted at the output end of each motor, the positioning clamping cylinder is fixed on the side of the frame, and the output end of the positioning clamping cylinder is connected with the first sliding plate. The wheel is put on a positioning roller bed by a manipulator, the positioning clamping cylinder is started to drive the four clamping wheels to position and clamp the wheel, and rotation of the wheel can be controlled via the four clamping wheel drive motors.

The two second cylinders are fixed at the top of the frame, output ends of the two second cylinders are connected with the second lifting table, and the two second cylinders controls the up and down movements of the second lifting table under the guidance of the four second guide posts. The third servo motor is fixed on the second lifting table, and the second rotating table is mounted at the output end of the third servo motor. The six front brush adjustment cylinders are mounted on the second rotating table, in which three of them are mounted on the first side of the second rotating table, the other three are mounted on the second side of the second rotating table, output ends of the six front brush adjustment cylinders are connected with the six sliding blocks, the six sliding blocks are matched with a slide way in the second rotating table, and a wheel front brush is mounted on each sliding block. When the third servo motor drives the second rotating table to rotate, the three wheel front brushes on the second side are equivalent to being mirrored to the first side and are connected with the three wheel front brushes on the first side to form a closely connected integral brush. When the six wheel front brushes are distributed on two sides, the effect that all the wheel front brushes are on the same side can be achieved, and the problem of space limitation can also be solved; and the heights of the six wheel front brushes can be adjusted via the six front brush adjustment cylinders to match the shape of the front of the wheel, the six wheel front brushes follow up the shape of the front of the wheel, and the front burrs can thus be cleaned thoroughly. The center brush adjustment cylinder is mounted in the center of the second rotating table, and a wheel front center brush for brushing burrs from a center riser of the wheel is mounted at the output end of the center brush adjustment cylinder.

The working process of the wheel shape follow-up burr brushing device is: firstly, the positions of all brushes are adjusted according to the shape of the wheel, so that the integral brush formed by the six wheel front brushes follows up the shape of the front of the wheel, the integral brush formed by the six wheel back cavity brushes follows up the shape of the back cavity of the wheel, and the spoke root groove brush follows up the shape of the groove; the wheel having burrs going to be brushed is put onto the positioning roller bed by a manipulator, then the positioning clamping cylinder is started, the wheel is clamped by the four clamping wheels, next, the four clamping wheel drive motors are started, so that the wheel is in a low-speed rotating state; then the two second cylinders are started to drive the rotating second rotating table to be fed downwards, the two first cylinders are started to drive the rotating first rotating table to be fed upwards, and the rotating wheel is matched with the rotating brushes to complete shape follow-up burr brushing on the front, back cavity and spoke root groove of the wheel.

The heights of the six wheel back cavity brushes are adjusted via the six back cavity brush adjustment cylinders, so that the contour formed by the six wheel back cavity brushes can be consistent with the shape of the back cavity of the wheel, and the six wheel back cavity brushes follow up the shape of the back cavity of the wheel; the inclination angle of the spoke root groove brush and the depth of the spoke root groove brush entering the groove can be adjusted via the angle adjustment cylinder and the groove brush adjustment cylinder, so that the spoke root groove brush follows up the shape of the spoke root groove; and the heights of the six wheel front brush brushes can be adjusted via the six front brush adjustment cylinders to match the shape of the front of the wheel, so that the six wheel front brush brushes follow up the shape of the front of the wheel. By adjusting the structures of the brushes, the device can be suitable for brushing burrs from wheels in multiple shapes, so the device has wider applicability, can brush burrs thoroughly and greatly reduce the manufacturing cost, and is novel in structure, advanced in technology and strong in universality.

LIST OF REFERENCE SYMBOLS

Figure 1:
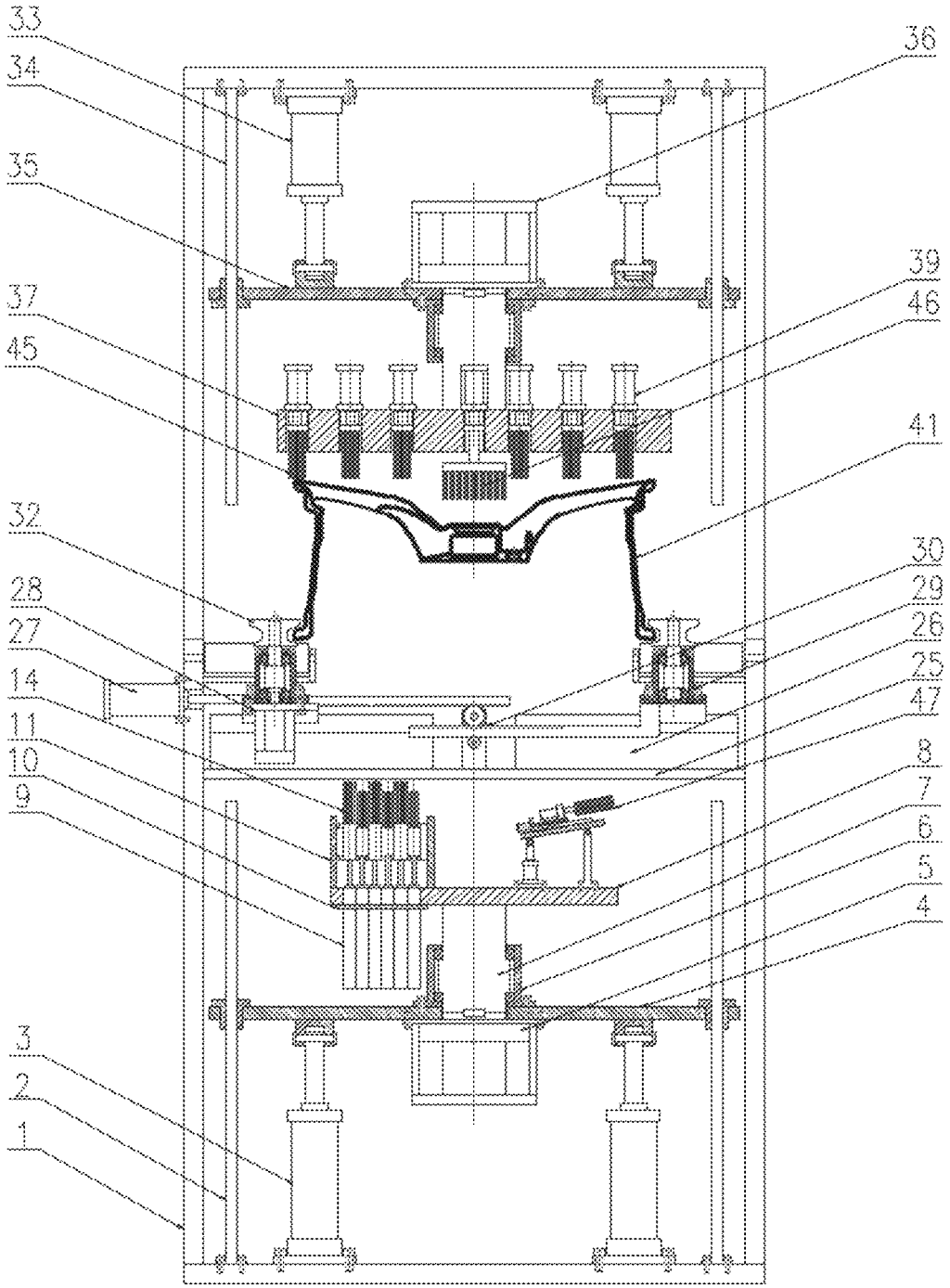
FIG. 1 is a front view of a wheel shape follow-up burr brushing device of the disclosure.
Figure 2:
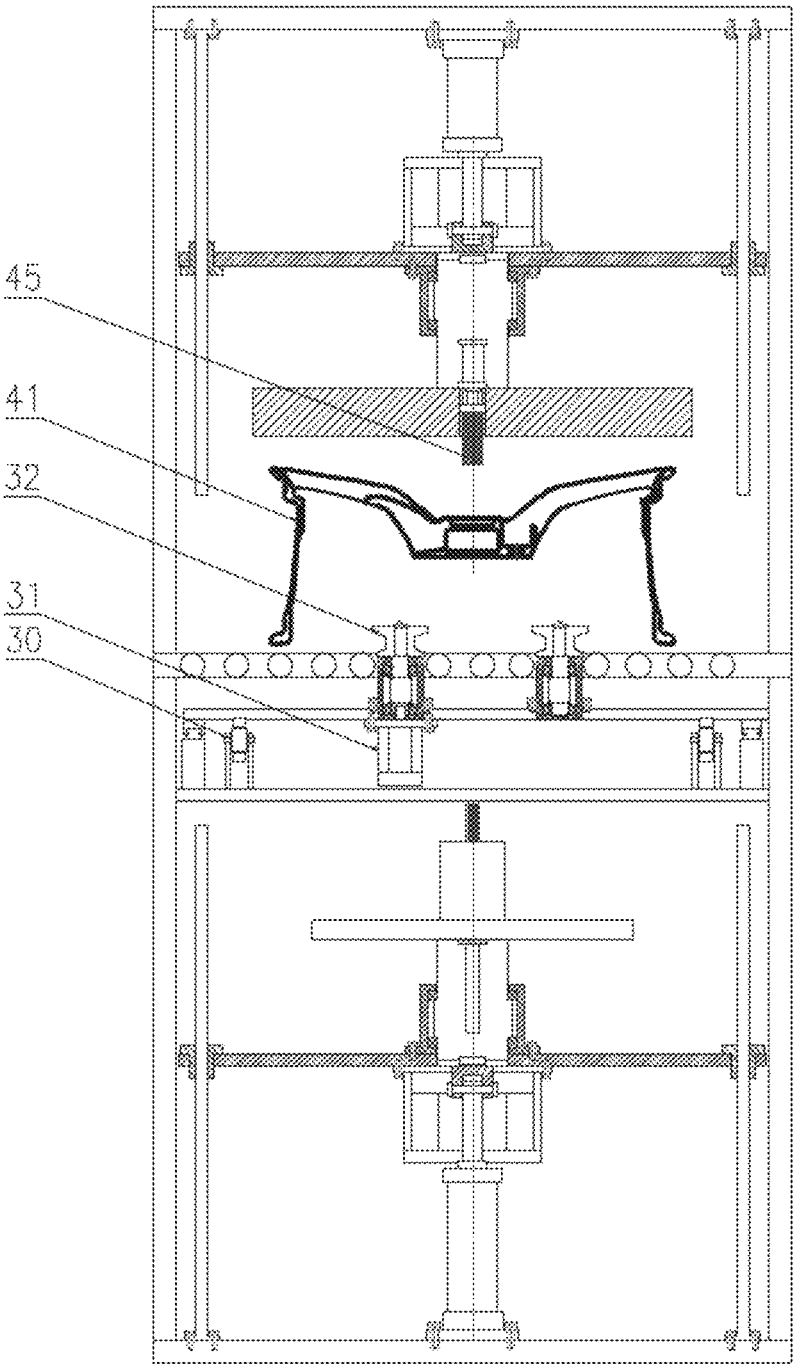
FIG. 2 is a left view of the wheel shape follow-up burr brushing device of the disclosure.
Figure 3:
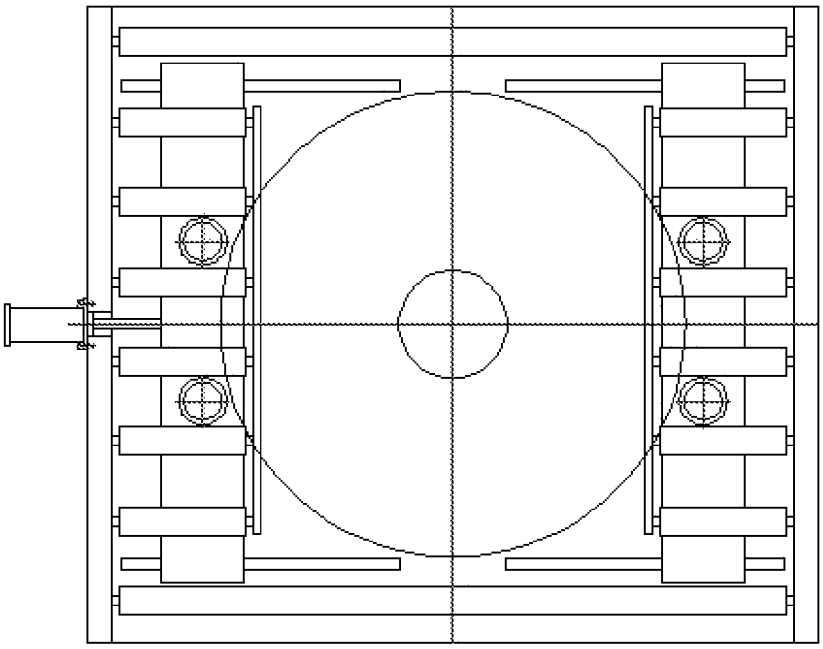
FIG. 3 is a top view of the wheel shape follow-up burr brushing device of the disclosure.
Figure 4:
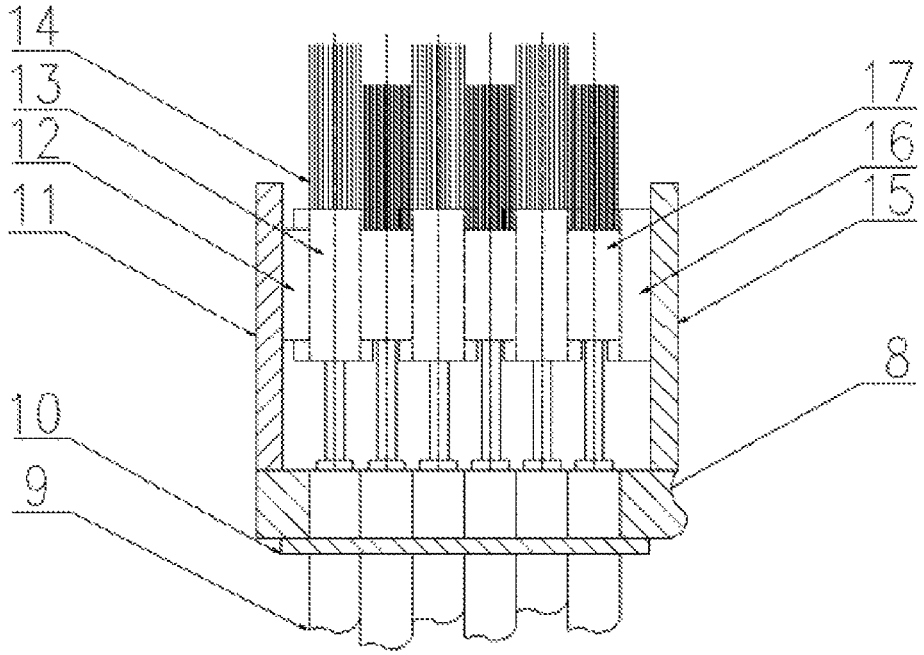
FIG. 4 is an enlarged front view of a back cavity brush system of the wheel shape follow-up burr brushing device of the disclosure.
Figure 5:
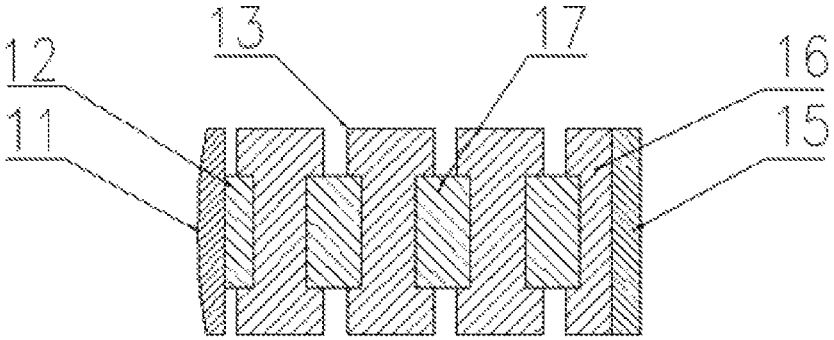
FIG. 5 is an enlarged top view of the back cavity brush system of the wheel shape follow-up burr brushing device of the disclosure.
Figure 6:
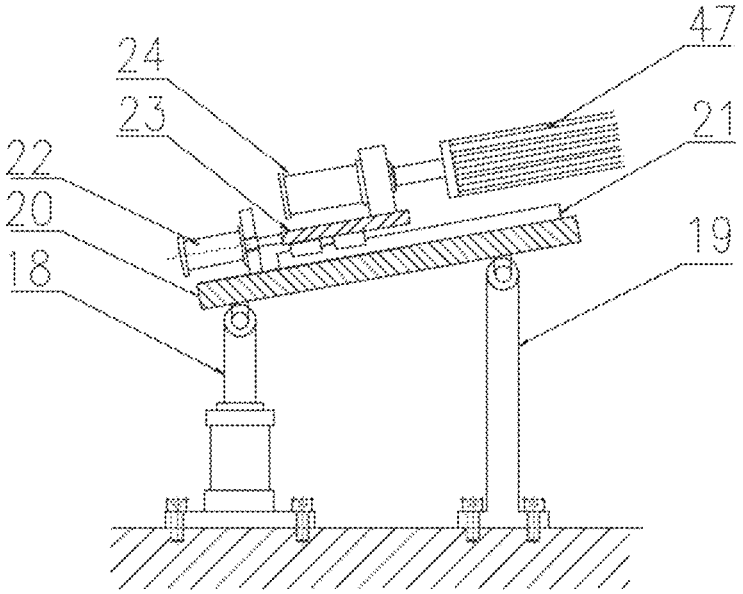
FIG. 6 is an enlarged front view of a groove brush system of the wheel shape follow-up burr brushing device of the disclosure.
Figure 7:
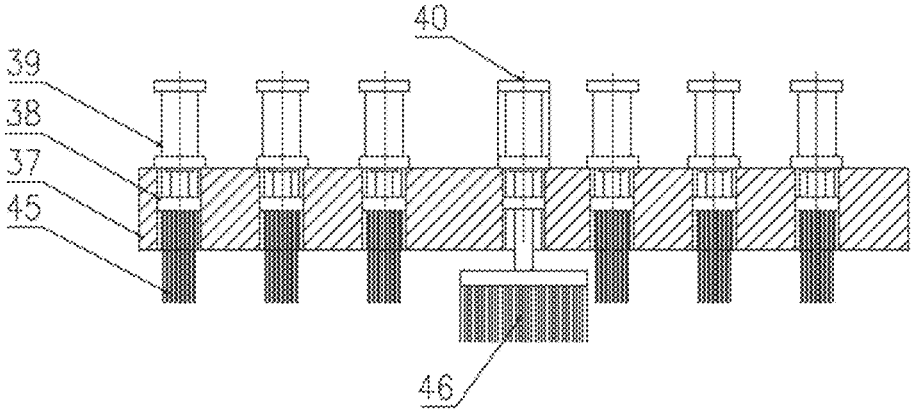
FIG. 7 is an enlarged front view of a front brush system of the wheel shape follow-up burr brushing device of the disclosure.
Figure 8:
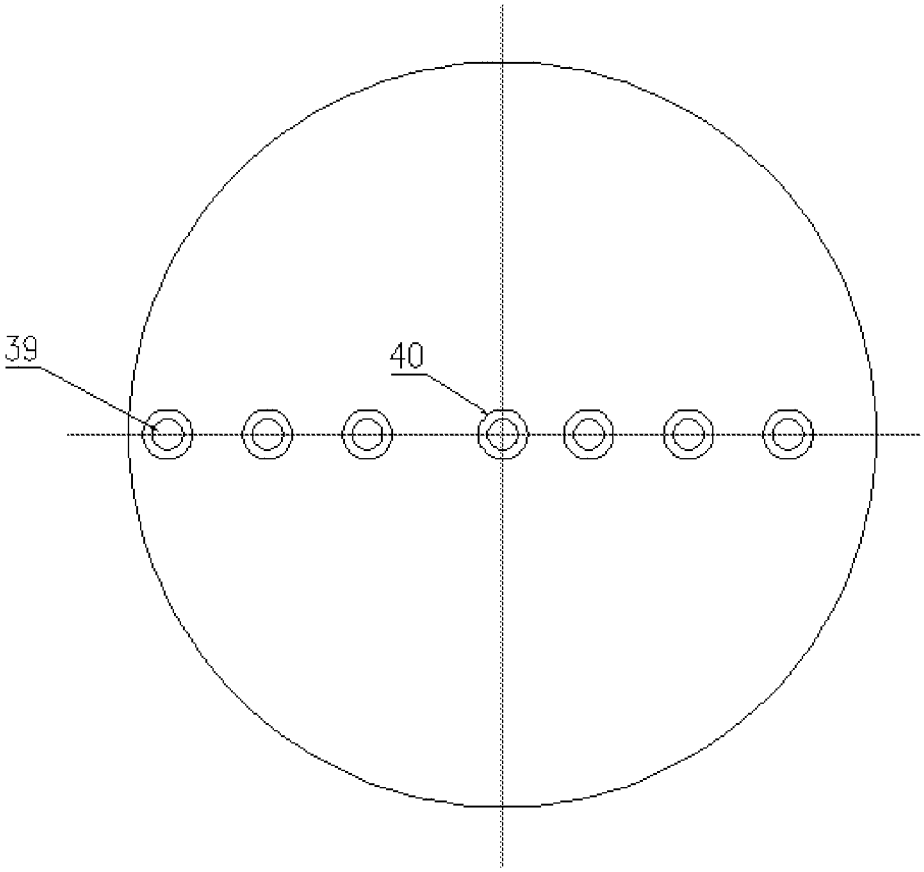
FIG. 8 is an enlarged top view of the front brush system of the wheel shape follow-up burr brushing device of the disclosure.
Figure 9:
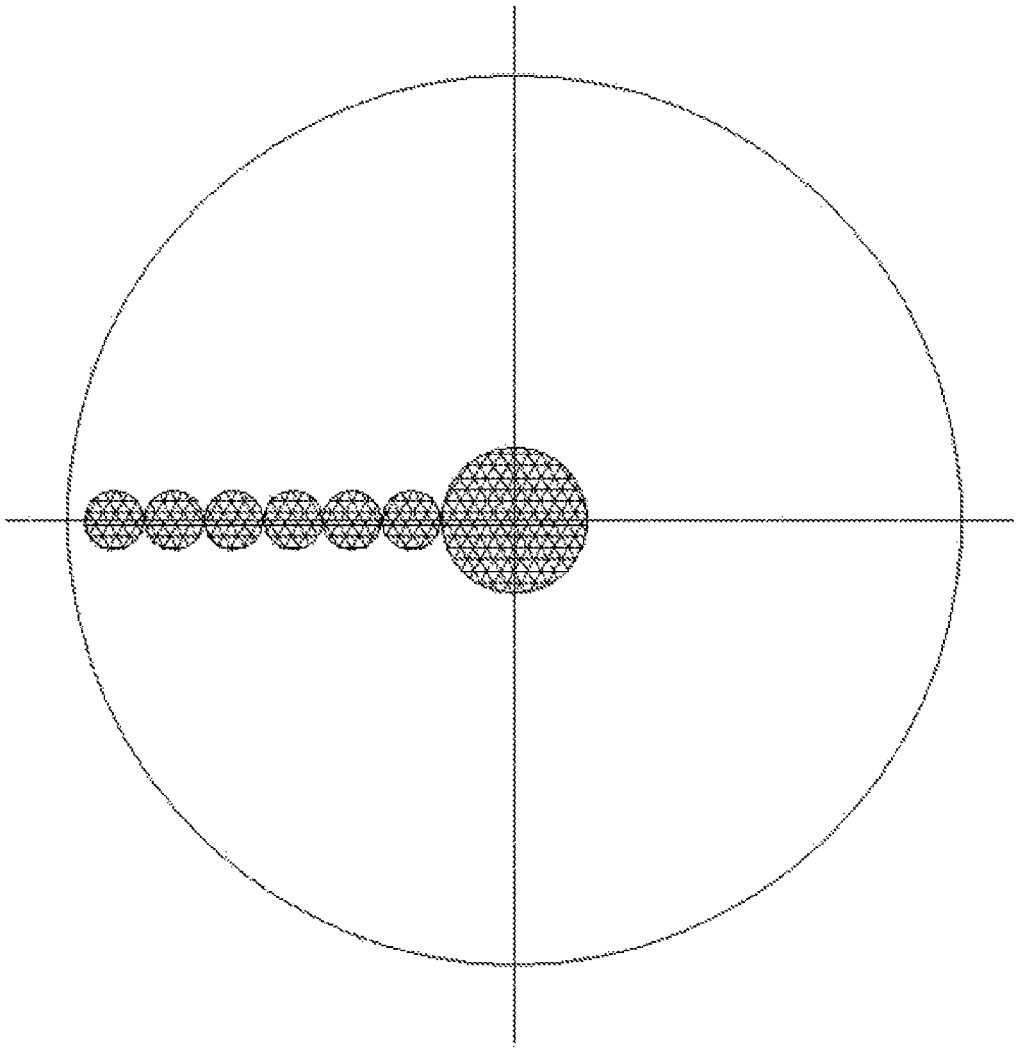
FIG. 9 is a schematic diagram when front brushes of the wheel shape follow-up burr brushing device of the disclosure are mirrored to the first side.
Figure 10:
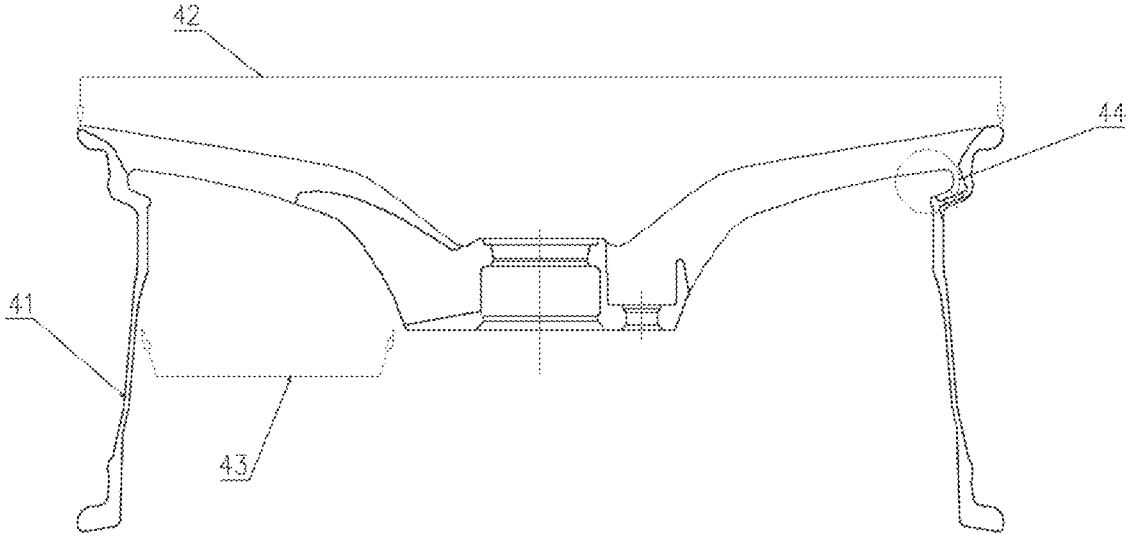
FIG. 10 is a schematic diagram of the wheel of the disclosure.

1 frame
2 first guide post
3 first cylinder
4 first lifting table
5 first servo motor
6 bearing seat
7 shaft
8 first rotating table

9 back cavity brush adjustment cylinder
10 fixed plate
11 first support plate
12 fixed guidance key
13 I-shaped sliding block
14 wheel back cavity brush
15 second support plate
16 concave block
17 movable guidance key
18 angle adjustment cylinder
19 upright post
20 turning plate
21 guide rail
22 groove brush adjustment cylinder
23 adjustment sliding block
24 second servo motor
25 third support plate
26 positioning guide rail
27 positioning clamping cylinder
28 first sliding plate
29 second sliding plate
30 gear rack
31 clamping wheel drive motor
32 clamping wheel
33 second cylinder
34 second guide post
35 second lifting table
36 third servo motor
37 second rotating table
38 sliding block
39 front brush adjustment cylinder
40 center brush adjustment cylinder
41 wheel
42 front of wheel
43 back cavity of wheel
44 spoke root groove
45 wheel front brush
46 wheel front center brush
47 spoke root groove brush

DETAILED DESCRIPTION

Specific details and working conditions of a device provided by the disclosure will be given below in combination with the accompanying drawings.

A wheel shape follow-up burr brushing device is composed of a frame 1, four first guide posts 2, two first cylinders 3, a first lifting table 4, a first servo motor 5, a bearing seat 6, a shaft 7, a first rotating table 8, six back cavity brush adjustment cylinders 9, a fixed plate 10, a first support plate 11, a fixed guidance key 12, three I-shaped sliding blocks 13, six wheel back cavity brushes 14, a second support plate 15, a concave block 16, three movable guidance keys 17, an angle adjustment cylinder 18, an upright post 19, a turning plate 20, a guide rail 21, a groove brush adjustment cylinder 22, an adjustment sliding block 23, a second servo motor 24, a third support plate 25, four positioning guide rails 26, a positioning clamping cylinder 27, a first sliding plate 28, a second sliding plate 29, a gear rack 30, four clamping wheel drive motors 31, four clamping wheels 32, two second cylinders 33, four second guide posts 34, a second lifting table 35, a third servo motor 36, a second rotating table 37, six sliding blocks 38, six front brush adjustment cylinders 39 and a center brush adjustment cylinder 40.

The two first cylinders 3 are fixed at the bottom of the frame 1, output ends of the two first cylinders 3 are connected with the first lifting table 4, and the two first cylinders 3 controls the up and down movements of the first lifting table 4 under the guidance of the four first guide posts 2. The first servo motor 5 is fixed on the first lifting table 4, the first rotating table 8 is mounted at the output end of the first servo motor 5, six wheel back cavity brushes 14 are mounted at the first half part of the first rotating table 8, and a spoke root groove brush 47 is mounted at the second half part of the first rotating table 8.

The six back cavity brush adjustment cylinders 9 are arranged in one row and comprise a first back cavity brush adjustment cylinder, a second back cavity brush adjustment cylinder, a third back cavity brush adjustment cylinder, a fourth back cavity brush adjustment cylinder, a fifth back cavity brush adjustment cylinder and a sixth back cavity brush adjustment cylinder arranged in a radially inward direction respectively, and are fixed at the lower part of the first rotating table 8 via the fixed plate 10. Output ends of the first back cavity brush adjustment cylinder, the third back cavity brush adjustment cylinder and the fifth back cavity brush adjustment cylinder are connected with the three I-shaped sliding blocks 13, output ends of the second back cavity brush adjustment cylinder, the fourth back cavity brush adjustment cylinder and the sixth back cavity brush adjustment cylinder are connected with the three movable guidance keys 17, and grooves of the three I-shaped sliding blocks 13 are matched with the three movable guidance keys 17. The first support plate 11 is fixed on the first rotating table 8, the fixed guidance key 12 is fixed on the first support plate 11, and the I-shaped sliding block of the three I-shaped sliding blocks 13 closest to the first support plate 11 is matched with the fixed guidance key 12. The second support plate 15 is fixed on the first rotating table 8, the concave block 16 is fixed on the second support plate 15, and the movable guidance key of the three movable guidance keys 17 closest to the second plate 15 is matched with the concave block 16. A wheel back cavity brush 14 is mounted at the top of each of the three I-shaped sliding blocks 13 and the three movable guidance keys 17, and when the six back cavity brush adjustment cylinders 9 extend and retract, all the bushes can move up and down without interfering with each other under the coordination of the three I-shaped sliding blocks 13 and the three movable guidance keys 17. By adjusting the heights of the six wheel back cavity brushes, the contour formed by the six wheel back cavity brushes can be consistent with the shape of the back cavity 43 of a wheel 41, the six wheel back cavity brushes follow up the shape of the back cavity of the wheel, in this case, burrs can be brushed thoroughly from the back cavity of the wheel, moreover, the six wheel back cavity brushes are more universal, and the heights of the bushes can be adjusted to match wheels in different shapes, so that the production cost is greatly reduced.

Both the angle adjustment cylinder 18 and the upright post 19 are fixed on the first rotating table 8, the lower part of the turning plate 20 is articulated with the angle adjustment cylinder 18, the lower part of the turning plate 20 is articulated with the upright post 19, both the groove brush adjustment cylinder 22 and the guide rail 21 are fixed on the turning plate 20, the output end of the groove brush adjustment cylinder 22 is connected with the adjustment sliding block 23, the adjustment sliding block 23 is mounted on the guide rail 21, the second servo motor 24 is fixed on the adjustment sliding block 23, and a spoke root groove brush 47 is mounted at the output end of the second servo motor 24. The inclination angle of the spoke root groove brush can be adjusted via the angle adjustment cylinder 18, so that the spoke root groove brush is consistent with a spoke root groove in angle; the depth of the spoke root groove brush entering the groove can be adjusted via the groove brush adjustment cylinder 22, so that the spoke root groove brush is consistent with the spoke root groove in depth; the spoke root groove brush can rotate via the second servo motor 24, and under the coordination of rotation of the wheel, burrs can be cleaned from the spoke root groove 44.

The third support plate 25 is fixed in the middle of the frame 1, the four positioning guide rails 26 are symmetrically mounted on the third support plate 25, the first sliding plate 28 and the second sliding plate 29 are symmetrically mounted on the four positioning guide rails 26 and connected with each other via the gear rack 30, the first sliding plate 28 and the second sliding plate 29 are respectively provided with two clamping wheel drive motors 31, a clamping wheel 32 is mounted at the output end of each motor, the positioning clamping cylinder 27 is fixed on the side of the frame 1, and the output end of the positioning clamping cylinder 27 is connected with the first sliding plate 28. The wheel is put on a positioning roller bed by a manipulator, the positioning clamping cylinder 27 is started to drive the four clamping wheels 32 to position and clamp the wheel, and rotation of the wheel can be controlled via the four clamping wheel drive motors 31.

The two second cylinders 33 are fixed at the top of the frame 1, output ends of the two second cylinders 33 are connected with the second lifting table 35, and the two second cylinders 33 controls the up and down movements of the second lifting table 35 under the guidance of the four second guide posts 34. The third servo motor 36 is fixed on the second lifting table 35, and the second rotating table 37 is mounted at the output end of the third servo motor 36. The six front brush adjustment cylinders 39 are mounted on the second rotating table 37, in which three of them are mounted on the first side of the second rotating table 37, the other three are mounted on the second side of the second rotating table 37, output ends of the six front brush adjustment cylinders 39 are connected with the six sliding blocks 38, the six sliding blocks 38 are matched with a slide way in the second rotating table 37, and a wheel front brush 45 is mounted on each sliding block 38. When the third servo motor 36 drives the second rotating table 37 to rotate, the three wheel front brushes on the second side are equivalent to being mirrored to the first side and are connected with the three wheel front brushes on the first side to form a closely connected integral brush. When the wheel front brushes are distributed on two sides, the effect that the six wheel front brushes are on the same side can be achieved, and the problem of space limitation can also be solved; and the heights of the six wheel front brushes can be adjusted via the six front brush adjustment cylinders 39 to match the shape of the front 42 of the wheel, the six wheel front brushes follow up the shape of the front of the wheel, and the front burrs can thus be cleaned thoroughly. The center brush adjustment cylinder 40 is mounted in the center of the second rotating table 37, and a wheel front center brush 46 for brushing burrs from a center riser of the wheel is mounted at the output end of the center brush adjustment cylinder 40.

The working process of the wheel shape follow-up burr brushing device is: firstly, the positions of all brushes are adjusted according to the shape of the wheel, so that the integral brush formed by the six wheel front brushes follows up the shape of the front of the wheel, the integral brush formed by the six wheel back cavity brushes follows up the shape of the back cavity of the wheel, and the spoke root groove brush follows up the shape of the groove; the wheel having burrs going to be brushed is put onto the positioning roller bed by a manipulator, then the positioning clamping cylinder 27 is started, the wheel is clamped by the four clamping wheels 32, next, the four clamping wheel drive motors 31 are started, so that the wheel is in a low-speed rotating state; then the two second cylinders 33 are started to drive the rotating second rotating table 37 to be fed downwards, the two first cylinders 3 are started to drive the rotating first rotating table 8 to be fed upwards, and the rotating wheel is matched with the rotating brushes to complete shape follow-up burr brushing on the front, back cavity and spoke root groove of the wheel.

The heights of the wheel back cavity brushes are adjusted via the six back cavity brush adjustment cylinders, so that the contour formed by the six wheel back cavity brushes can be consistent with the shape of the back cavity of the wheel, and the six wheel back cavity brushes follow up the shape of the back cavity of the wheel; the inclination angle of the spoke root groove brush and the depth of the spoke root groove brush entering the groove can be adjusted via the angle adjustment cylinder and the groove brush adjustment cylinder, so that the spoke root groove brush follows up the shape of the spoke root groove; and the heights of the six wheel front brushes can be adjusted via the six front brush adjustment cylinders to match the shape of the front of the wheel, so that the six wheel front brushes follow up the shape of the front of the wheel. By adjusting the structures of the brushes, the device can be suitable for brushing burrs from wheels in multiple shapes, so the device has wider applicability, can brush burrs thoroughly and greatly reduce the manufacturing cost, and is novel in structure, advanced in technology and strong in universality.

The invention claimed is:

1. A wheel shape follow-up burr brushing device, comprising: two first cylinders, a first servo motor, a first rotating table, six back cavity brush adjustment cylinders, a first support plate, a fixed guidance key, three I-shaped sliding blocks, six wheel back cavity brushes, a second support plate, a concave block, three movable guidance keys, a positioning clamping cylinder, four clamping wheel drive motors, four clamping wheels, two second cylinders, a third servo motor, a second rotating table, six sliding blocks, and six front brush adjustment cylinders;

wherein:

the six back cavity brush adjustment cylinders are arranged in one row and comprise a first back cavity brush adjustment cylinder, a second back cavity brush adjustment cylinder, a third back cavity brush adjustment cylinder, a fourth back cavity brush adjustment cylinder, a fifth back cavity brush adjustment cylinder and a sixth back cavity brush adjustment cylinder arranged in a radially inward direction respectively, output ends of the first back cavity brush adjustment cylinder, the third back cavity brush adjustment cylinder and the fifth back cavity brush adjustment cylinder being connected with the three I-shaped sliding blocks, output ends of the second back cavity brush adjustment cylinder, the fourth back cavity brush adjustment cylinder and the sixth back cavity brush adjustment cylinder being connected with the three movable guidance keys, and grooves of the three I-shaped sliding blocks being matched with the three movable guidance keys; the first support plate being fixed on the first rotating table, the fixed guidance key being fixed on the first support plate, and an I-shaped sliding block of the three I-shaped sliding blocks closest to the first support plate being matched with the fixed guidance key; the second support plate being fixed on the first rotating table, the concave block being fixed on the second support plate, and a movable guidance key of the three movable guidance keys closest to the second support plate being matched with the concave block; a wheel back cavity brush of the six wheel back cavity brushes being mounted at a top of each of the three I-shaped sliding blocks and the three movable guidance keys; the six back cavity brush adjustment cylinders being configured to drive the six wheel back cavity brushes to move up and down under a coordination of the three I-shaped sliding blocks and the three movable guidance keys; a contour formed by the six wheel back cavity brushes being consistent with a shape of a back cavity of a wheel by adjusting heights of the six wheel back cavity brushes; the first rotating table and the six wheel back cavity brushes being driven into rotation by the first servo motor;

the six front brush adjustment cylinders are mounted on the second rotating table, three of the six front brush adjustment cylinders being mounted on a first side of the second rotating table, another three of the six front brush adjustment cylinders being mounted on a second side of the second rotating table, output ends of the six front brush adjustment cylinders being connected with the six sliding blocks, the six sliding blocks being matched with a slide way in the second rotating table, and a wheel front brush of six wheel front brushes being mounted on each sliding block of the six sliding blocks; and when the third servo motor drives the second rotating table and the six wheel front brushes to rotate, three wheel front brushes of the six wheel front brushes on the second side of the second rotating table are equivalent to being mirrored to the first side of the second rotating table and are connected with three wheel front brushes of the six wheel front brushes on the first side of the second rotating table to form an integral brush, heights of the six wheel front brushes being adjusted via the six front brush adjustment cylinders to match a shape of a front of the wheel; and the wheel is put onto a positioning roller bed by a manipulator, the positioning clamping cylinder driving the four clamping wheels to clamp the wheel, the four clamping wheel drive motors driving the wheel to be in a low-speed rotating state; the two second cylinders driving the second rotating table to be fed downwards, the two first cylinders driving the first rotating table to be fed upwards, and the wheel being matched with the six wheel back cavity brushes and the six wheel front brushes to brush burrs from the wheel.

* * * * *